US008257766B2

(12) United States Patent
Yoakim et al.

(10) Patent No.: US 8,257,766 B2
(45) Date of Patent: Sep. 4, 2012

(54) CAPSULE FOR PREPARATION OF A BEVERAGE WITH DELAMINATING OR BREAKABLE SEAL AT DELIVERY WALL

(75) Inventors: Alfred Yoakim, St. Legier-la Chiesaz (CH); Patrice Borne, Publier (FR)

(73) Assignee: Nestec S.A., Vevey (CH)

( * ) Notice: Subject to any disclaimer, the term of this patent is extended or adjusted under 35 U.S.C. 154(b) by 240 days.

(21) Appl. No.: 12/756,882

(22) Filed: Apr. 8, 2010

(65) Prior Publication Data

US 2010/0260896 A1 Oct. 14, 2010

(30) Foreign Application Priority Data

Apr. 9, 2009 (EP) ..... 09157701
Aug. 26, 2009 (EP) ..... 09168665

(51) Int. Cl.
*B65B 29/02* (2006.01)
*A47J 31/06* (2006.01)

(52) U.S. Cl. ..... 426/77; 99/295; 99/279; 99/300

(58) Field of Classification Search ..... 426/77; 99/295, 495, 279, 300
See application file for complete search history.

(56) References Cited

U.S. PATENT DOCUMENTS

| | | | | |
|---|---|---|---|---|
| 3,292,527 | A | 12/1966 | Stasse | 99/295 |
| 4,053,371 | A | 10/1977 | Towsley | 204/20 |
| 4,846,052 | A | 7/1989 | Favre et al. | 99/295 |
| 4,853,234 | A | 8/1989 | Bentley et al. | 426/77 |
| 4,886,674 | A | 12/1989 | Seward et al. | 426/79 |
| 5,242,702 | A | 9/1993 | Fond | 426/433 |
| 5,402,707 | A | 4/1995 | Fond et al. | 99/295 |
| 5,472,719 | A | 12/1995 | Favre | 426/77 |
| 6,832,542 | B2 | 12/2004 | Hu et al. | |
| 7,393,446 | B2 | 7/2008 | Towsley | 205/109 |
| 2003/0096038 | A1 | 5/2003 | Cai | 426/77 |
| 2004/0115310 | A1 | 6/2004 | Yoakim et al. | 426/77 |
| 2004/0115317 | A1 | 6/2004 | Doglioni | 426/123 |
| 2005/0150390 | A1 | 7/2005 | Schifferle | 99/295 |
| 2006/0110507 | A1 | 5/2006 | Yoakim et al. | 426/433 |
| 2007/0186784 | A1 | 8/2007 | Liverani et al. | 99/295 |
| 2007/0224319 | A1 | 9/2007 | Yoakim et al. | 426/433 |
| 2007/0261564 | A1 | 11/2007 | Suggi Liverani et al. | 99/279 |
| 2009/0280219 | A1 | 11/2009 | Yoakim et al. | 426/77 |

FOREIGN PATENT DOCUMENTS

| | | | |
|---|---|---|---|
| BE | 1 006 165 | A5 | 5/1994 |
| EP | 0 179 641 | B1 | 4/1986 |
| EP | 0 242 556 | A1 | 10/1987 |
| EP | 0 468 078 | A1 | 1/1992 |

(Continued)

OTHER PUBLICATIONS

Search Report, European Application No. 09155571, Oct. 9, 2009.

(Continued)

*Primary Examiner* — Rena Dye
*Assistant Examiner* — Chaim Smith
(74) *Attorney, Agent, or Firm* — Winston & Strawn LLP

(57) ABSTRACT

A capsule for preparation of a beverage in a beverage production machine. The capsule includes a body and a delivery wall forming a chamber containing ground coffee. The delivery wall has at least one outlet, an inner layer and an outer layer forming respectively first and second layers at least partially connected together by at least one seal portion which delaminates or breaks under the pressure of coffee liquid against the seal portion. Preferably, the seal portion extends in a direction (P) which differs from the direction (A) of the outlet.

20 Claims, 5 Drawing Sheets

FOREIGN PATENT DOCUMENTS

| | | | |
|---|---|---|---|
| EP | 0 512 468 | B1 | 11/1992 |
| EP | 0 512 470 | B1 | 11/1992 |
| EP | 0 554 469 | B1 | 8/1993 |
| EP | 0468079 | B1 | 9/1996 |
| EP | 1 165 398 | B1 | 1/2002 |
| EP | 1 273 528 | B1 | 1/2003 |
| EP | 1 579 792 | A1 | 9/2005 |
| EP | 1 654 966 | B1 | 5/2006 |
| EP | 1 700 548 | A1 | 9/2006 |
| EP | 1 702 543 | B1 | 9/2006 |
| EP | 1 929 904 | A1 | 6/2008 |
| WO | WO 02/058522 | A2 | 8/2002 |
| WO | WO 02/081337 | A1 | 10/2002 |
| WO | WO 03/073896 | | 9/2003 |
| WO | WO 2005/092160 | A1 | 10/2005 |

OTHER PUBLICATIONS

Search Report, European Application No. 09155575, Oct. 7, 2009.
Search Report, European Application No. 10156614, Jun. 24, 2010.
U.S. Appl. No. 12/727,790, filed Mar. 19, 2010.
U.S. Appl. No. 12/727,861, filed Mar. 19, 2010.
U.S. Appl. No. 12/756,865, filed Apr. 8, 2010.
U.S. Appl. No. 12/756,865 Non-Final Office Action mailed Jan. 12, 2012.

CAPSULE FOR PREPARATION OF A BEVERAGE WITH DELAMINATING OR BREAKABLE SEAL AT DELIVERY WALL

BACKGROUND

The present invention relates to a capsule for preparing a beverage such as coffee in a beverage production machine.

Single-use beverage capsules are very popular because they provide a fresh tasting beverage quickly, conveniently and in a clean fashion. Therefore, certain beverage capsule systems propose to extract a coffee liquid from roast and ground coffee ingredients contained in a capsule that opens under pressure when a sufficient amount of water has filled the capsule. More particularly, the pressure of liquid increases in the capsule before the delivery face of the capsule opens thereby conferring a good quality of extraction.

In order to provide a thorough interaction between the ingredients, e.g., ground coffee and hot water, it is desirable to delay the release of the beverage through the delivery side. Many different solutions already exist.

In particular, NESPRESSO® capsule system, as described in EP0512470B1, is based on the principle that an extraction face of the capsule is torn against relief and recessed elements of a capsule holder in the beverage production machine. The extraction face tears at the location of these relief elements and/or recessed elements on reaching the breaking stress to enable the liquid, e.g., coffee extract, to be removed after extraction of the coffee under a certain positive pressure. EP0512468B1 also describes a capsule which is adapted for such extraction process and device.

EP0179641 relates to a sachet comprising two sheets forming with a filtering web material the chamber for the ingredients. The two sheets are sealed at the bottom of the sachet to form a bottom seam that breaks under pressure of the beverage.

U.S. Pat. No. 4,853,234 relates to a beverage package wherein the outlet is opened automatically, in use, by the pressure of beverage. The pressure of beverage builds up in the outlet channel and causes the seal formed between a top portion and a rib to break. The beverage thus flows over the rib into a collection channel which funnels the beverage to form a stream which can be collected in a cup or other receptacle.

In both EP0179641 and U.S. Pat. No. 4,853,234, the flow of beverage leaving the capsule experiences a high velocity because the direction of the flow acting against the breakable seal is oriented in the direction of the outlet. Therefore, as soon as the seal is broken, the beverage leaves straightforwardly and rapidly the cartridge. As a result, when the cartridge is opened, the pressure in the capsule drops, hence the interaction between coffee and water becomes poor. Furthermore, the flow of beverage is given a too high velocity when leaving the capsule. Hence, the beverage can create splashes if it is not dampened properly before reaching the cup. Thus, improvements over these prior art devices are desirable.

SUMMARY OF THE INVENTION

The present invention aims at solving the above-mentioned problems and providing solutions for providing a better interaction water-ingredients in the capsule, in particular, with a more sustained pressure in the capsule during extraction.

For this, the invention relates to a capsule for preparation of a beverage or liquid food in a beverage production machine comprising a body and a delivery wall forming a chamber containing beverage ingredient, The delivery wall comprises at least one outlet, with inner and outer layers, respectively forming first and second layers, at least partially connected together by at least one seal portion which delaminates or breaks under the pressure of beverage liquid against said seal portion. Advantageously, the seal portion extends in a direction which differs from the direction of the outlet.

Therefore, when the seal of the capsule is opened under the pressure of beverage, the flow of liquid must be given a different direction before leaving the capsule. The flow is thus hindered sufficiently to maintain an elevated pressure in the chamber during release of the beverage. The pressure in the capsule can thus be leveled off after opening of the capsule or at least be prevented from dropping too quickly or brutally. In particular, the seal portion extends in a direction which forms an inclination of at least 25 degrees, preferably of about 90 degrees relative to the outlet.

The capsule generally contains particles for formation of a beverage upon contact with a fluid that is injected into the capsule.

BRIEF DESCRIPTION OF THE DRAWINGS

The invention will now be described in relation to the figures attached, wherein.

DETAILED DESCRIPTION OF THE INVENTION

Figure 1:
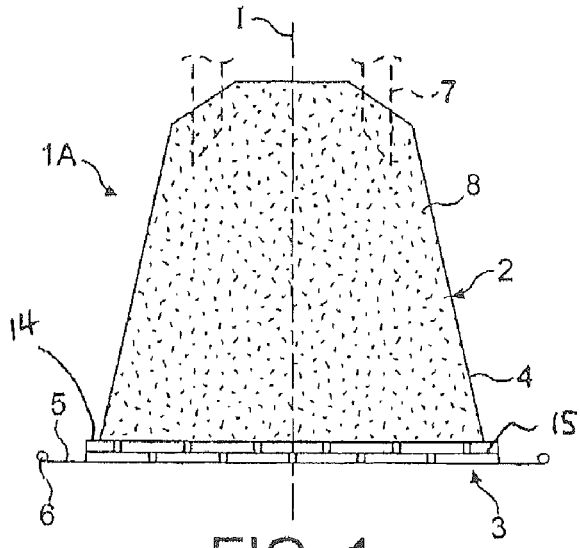
FIG. 1 is a cross section view of a capsule according to a first embodiment of the invention.

As used herein, the term "outlet" means any orifice provided in the delivery wall for allowing the beverage to leave the capsule. The outlet may be pre-formed in the delivery wall. The delivery wall may thus comprise one or a plurality of outlet orifices. The outlet may also be formed by a mechanical or fluidic process before or during the preparation of the beverage. For instance, one or a plurality of outlet orifices can be formed by piercing or cutting when the capsule is inserted in the beverage production machine or as a result of a mechanical stress or another stress provided by liquid, gas pressure, heat, laser and combinations thereof. Therefore, the outlet may not be materialized before use of the capsule but may appear at use of the capsule.

The direction of the outlet is defined as the general direction of the axis of the outlet, e.g., a longitudinal axis passing through the central axis of the orifice. This direction generally defines the direction of the flow when immediately leaving the capsule.

The term "seal portion" refers to a connection portion between the first and second layers which ruptures when a liquid beverage contacts it under a sufficient pressure. The seal portion extends, as aforementioned, in a direction that differs from the direction of the outlet. The two layers can, as well, connect together at several seal portions which extend in different directions.

In a particular mode of the invention, the first layer comprises at least a first orifice and the second layer comprises at least a second orifice wherein the flow path between said first and second orifices is closed by the seal portion before delamination or breakage and opened thereafter. In particular, the first and second orifices are substantially offset one another in the transversal direction of the capsule. This characteristic contributes to hindering the flow of beverage at the delivery wall. The flow cannot traverse the delivery wall before having taken a tortuous path through the delivery wall. Since the delivery wall forms a relatively confined volume for the beverage flow, a relatively high pressure drop is created at the wall which thus contributes to maintaining a high pressure in the chamber of the capsule even after the delamination or breaking of the seal portion.

In a more defined mode, the seal portion is provided along a transversal plane (P) of extension of the delivery wall. The outlet is defined preferably along or parallel to the longitudinal axis of the capsule. Therefore, the flow of beverage must act on the seal portion in a direction that is substantially normal to the direction of the flow in the capsule. Therefore, the seal ruptures at a higher pressure than if the seal portion extends in a direction normal to the delivery wall. A higher pressure in the capsule is also desired in particular for preparing coffee such as ristretto, espresso or lungo.

Preferably, the first (inner) layer comprises a plurality of first orifices. A high number of orifices enables to ensure an homogeneous distribution of liquid through the beverage ingredient, such as through the whole bed of coffee, and decreases the risk of privileged flow path.

More particularly, the first layer comprises a plurality of orifices of a diameter small enough to maintain ground coffee particles in the chamber. The first layer therefore can play the function of a filter by ensuring that the solid coffee particles are maintained in the chamber. Preferably, the diameter of the orifices is below 200 microns, most preferably between 10 and 100 microns.

Also, the second (outer) layer comprises a plurality of second orifices. Preferably, the orifices of the second layer, called "second orifices", enable the beverage to leave the capsule by forming the outlet of the capsule. The second orifices can create a pressure drop that maintains a high pressure in the chamber even after the opening of the delivery wall. For instance, the ratio of number of second orifices to number of first orifices is comprised between 1:500 to 1:2, most preferably between 1:100 and 1:10.

The individual cross section of the orifices of the second layer can be made larger than the individual cross section of the orifices of the first layer. In particular, the ratio of the diameter of the second orifices to the first orifices is comprised between about 10:1 to 2:1.

On the contrary the porosity of the second orifices can be lower than the porosity of the first orifices. Therefore, the beverage collected from the first layer is forced to pass through a second layer of lower porosity thereby resulting in a high pressure resistance through the wall and maintenance of a sufficient pressure in the capsule still after breakage of the seal portion. The porosity is defined here as the ratio of the void surface of the layer to the total surface of the layer.

Furthermore, the first and second layers of the delivery wall can be positioned adjacent one another. By "adjacent", it is meant that the layers are in direct contact or distant one another of no more than 0.3 mm (when the capsule is not yet submitted to the inside pressure of liquid) along at least 75% of their total surfaces. Indeed, it is desired to conceive the two layers with a confined area between the two layers in order to promote an hindered flow in a direction which differs from the direction of the flow through the outlet.

In an alternative, a gap is provided between the first and second layers. In particular, the gap may be utilized to control the rupture of the seal portion. When a gap is provided, the distance of the two layers is comprised between 0.1 and 1 mm, more preferably between 0.1 and 0.5 mm. The distance is hereby measured before use of the capsule when no liquid is pressurized on the delivery wall.

The seal portion can extend over the whole contact surfaces between the first and second layers.

Alternatively, the seal portion can extend only partially at the contact surfaces of the first and second layers. For instance, the first and second portions can be adjacent one another with a seal portion that seals only 50% of their contact surfaces. The seal portion may be formed of a continuous seal portion or of several discontinuous zones of the seal portion depending on the orifices' distribution in both layers. The principle is indeed to separate the first and second orifices by the seal portion in order that the opening at the delivery wall occurs only when a certain pressure has been attained in the capsule. Consequently, the design (e.g., dimensions, shape, tear strength) of the seal portion is configured to open at the desired pressure and may thus differ in function of the beverage to be delivered from the capsule (e.g., ristretto, espresso, lungo, etc.).

The first layer and second layer can be both flexible foils. The first and second layers may be foils having an individual thickness of between about 0.05 and 0.8 mm, preferably between 0.1 and 0.5 mm.

In a possible mode, the first layer can be more rigid than the second layer. In particular, the ratio of thickness of the first layer to the second layer can be comprised between 10:1 and 1.2:1, more preferably 5:1 and 2:1. By having the first layer more rigid, the second layer deforms more than the first layer thereby contributing to the breakage of the seal when a sufficient pressure is attained in the capsule. Such deformation can so be controlled to ensure a reliable and repeatable breakage from capsule to capsule.

In particular, the seal portion can be designed to delaminate or break when a pressure of at least 2 bars, preferably at least 3 bars is reached in the capsule. Most preferably, the seal portion is designed to break when a determined threshold of pressure of between 6 and 18 bars is reached. The "pressure" is meant here to be the value of pressure measured just upstream of the water injection wall of the capsule.

In a possible mode, the delivery wall can further comprise one or more restriction openings in the flowpath between the two layers and extending along the transversal direction of the capsule. Such opening may create a resistance to the flow after breakage of the seal portion to ensure that the pressure does not suddenly drop after breakage of the seal portion. Such restriction opening(s) preferably form an overall open surface area between 0.25 and 2.5 mm. The number of transversal restriction orifices should be low and preferably comprised between 1 and 4. For example, they may be delimited by a non-breakable seal portion which resists the liquid pressure.

In the present invention, the first and second layers of the delivery wall can comprise metal, plastic or paper alone or combinations thereof. Preferably, the first layer comprises aluminium, PP, PE, PA, PS, PVDC, EVOH, PET, cellulose and combinations thereof and the second layer comprises aluminium, PP, PE, PA, PS, PVDC, EVOH, PET and combinations thereof.

Regarding the dimensions of the capsule, the delivery wall of the capsule has preferably a diameter between 30 and 40 mm. The body of the capsule has preferably a height comprised between 27 and 30 mm. The rim of the capsule has preferably a width comprised between 3 and 5 mm.

Preferably, the rim of the capsule comprises a sealing means for providing a liquid-tight seal effect between a pressing surface of the injection part and the capsule. The seal means enables to fill radial grooves formed at the end pressing surface of the injection part as described in EP1654966 or EP1702543. More preferably, the sealing means forms at least one integral protrusion or lip extending from the rim or be an added seal element such as rubber, soft plastic, foam or fibres (e.g. paper, cardboard or synthetic or natural fibers).

The capsule preferably contains added inert gas such as nitrogen to reduce oxidation and extend freshness period of the ingredient. Nitrogen is typically flushed after or during filling the capsule with the ingredient and before sealing.

A first embodiment of the capsule 1A of the present invention is illustrated in FIGS. 1, 1A, 2 and 3. The capsule 1A comprises a delivery wall 3 and a self-supporting cup-shaped body 2 of circular section with an upper closed wall portion intended for the injection of water in the capsule, a truncated sidewall 4, a rim 5 extending outwardly and terminated by a curled end 6. As aforementioned, the body can be made of aluminium, plastic and/or paper and may be relatively stiff to not collapse when it is perforated by blades 7 of the coffee production machine; which blades provide openings through the capsule for the water injection. The cup-shaped body defines a chamber 8 containing the beverage ingredients in the form of particles. For example, when coffee is to be brewed, the particles are preferably roast and ground coffee. The dose of roast and ground coffee may vary depending on the type of coffee (ristretto, espresso or lungo). Generally, the amount of coffee contained in the chamber is of between 4.5 and 7 grams. The coffee powder is generally a single origin or a blend of different origins of Arabica and/or Robusta ground coffee. It should be noted that the body could take different other shapes and configurations. For instance, it could be made of different walls assembled together instead of being a cup-shaped member.

Figure 1A:
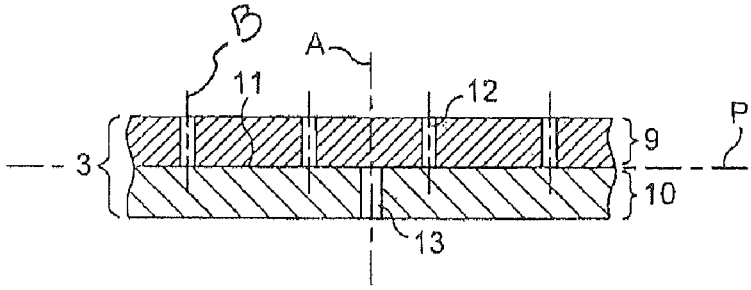
FIG. 1A is a detail view of the delivery wall of the capsule of FIG. 1.
Figure 3:
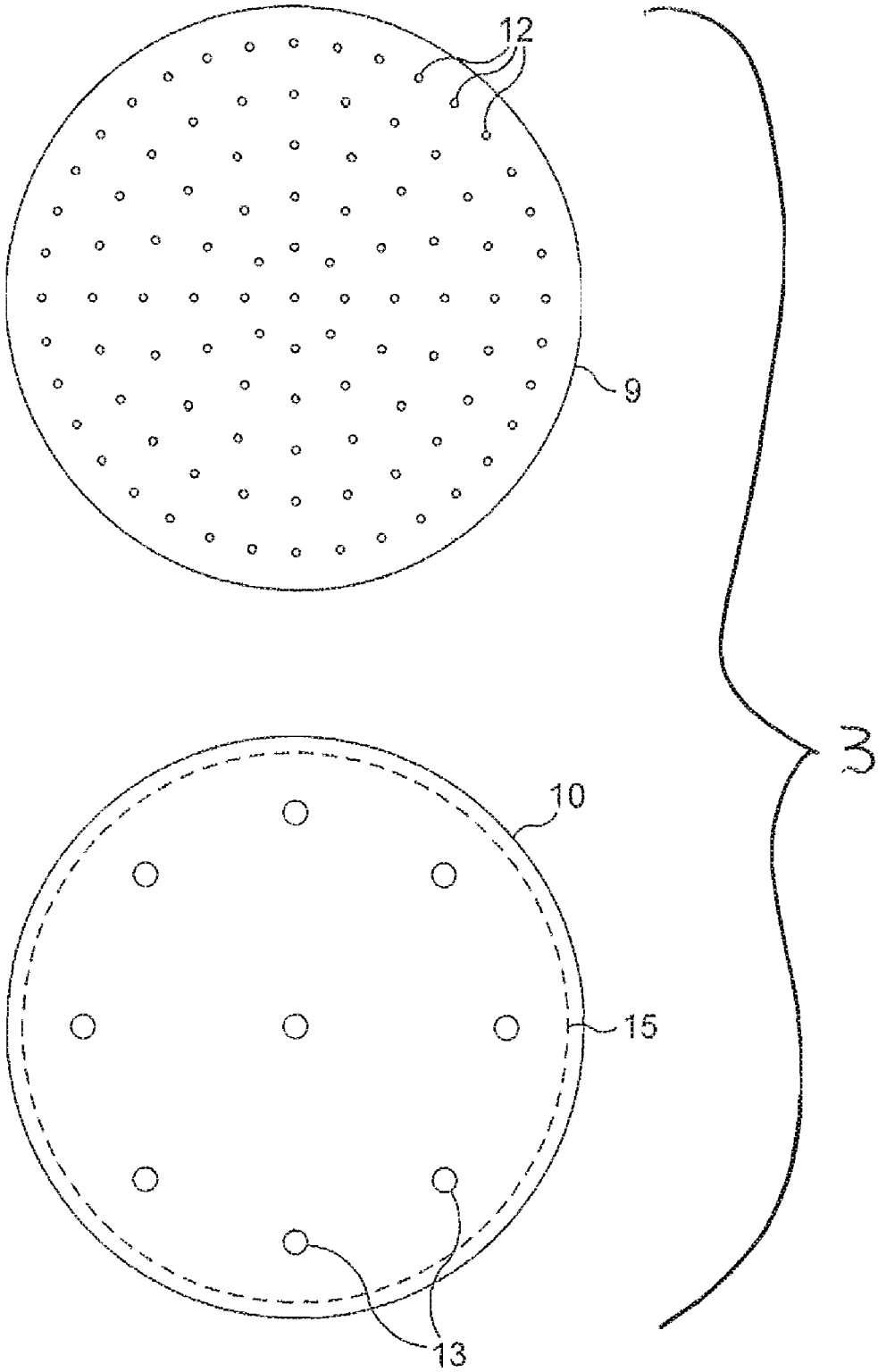
FIG. 3 is an exploded view of the delivery wall of the capsule of FIG. 1.

As illustrated in FIG. 1A in detail, the delivery wall 3 is formed of a first and second layers, respectively, an inner layer 9 and an outer layer 10. The two layers are sealed together along a seal portion 11 which covers the whole surfaces of contact between the two layers. Preferably, the first layer 9 is permeable to liquid by means of a plurality of small-size orifices 12 provided in its thickness. The orifices 12 forms pores through the layer of a diameter which is preferably below the average diameter ($D_{4,3}$) of the coffee particles contained in the chamber 8. The orifices are distributed all over the layer 9 to ensure the coffee extract to flow through the entire surface of the layer (FIG. 3). The terms "inner" and "outer" refer to the positioning of the layers one relative to the other in the delivery wall. However, they should not be interpreted as limiting the delivery wall to only two layers.

The second (outer) layer 10 is also made permeable to liquid by orifices 13. The second orifices 13 form the outlet of the capsule for the delivered beverage. Each orifice 13 of the second layer is thus arranged along an axis A which is substantially parallel to the longitudinal axis L of the capsule. The number and size of these second orifices 13 may differ in the number and size from the first orifices 12. In particular, the second layer 10 has a lower number of orifices than the first layer 9 but orifices of a larger individual diameter.

As illustrated in FIG. 1A, the delivery wall is arranged in sealing engagement of the two layers in a manner that the layers 9, 10 are substantially adjacent one another and the second orifices 13 are offset relative to the first orifices 12. Furthermore, the seal portion 11 connecting the first and second layers is arranged along a seal plane P which is oriented at about 90 degrees relative to the axis A of each orifice 13. As a matter of fact, the seal portion closes the flow path for liquid from the first orifices 12 to the second orifices 13.

The seal portion is made such that it can break or delaminate when a sufficient pressure of liquid acts thereon and/or onto the second layer 10 after having passed the first orifices 12. The seal portion can be made of a thermofusible material or an adhesive which is added between the two layers such as a thin sealing film (e.g., PE, EVA, etc.). The sealing film can be very thin, e.g., of several microns only. It can also be an integral part of the layers 9, 10 to form a breakable bond obtained such as by heat sealing. For instance, the two layers can be produced by laminating two permeable sheets under heat and pressure such as using heated rolls or a press. An intermediate fusible film may be necessary to obtain a breakable seal between the two sheets. The laminate is then cut to form circular delivery walls which can be sealed to the body 2 of the capsule.

The delivery wall 3 can be inserted and sealed into an annular recess of the body, e.g., obtained by a step portion of the sidewall 4, as illustrated in FIG. 1. Alternatively, the wall 3 can be sealed to the flange-like rim 5. Still another option is to seal the first layer 9 into the recess 14 and the second layer 10 onto the flange-like rim 5. It should also be noted that the first and second layers 9, 10 can be additionally connected in certain areas by a second seal portion which is not breakable under the pressure of the beverage. In particular, the two layers can be sealed at their periphery with a tear-resistant seal portion 15 (FIG. 3). Therefore, the outer layer 10 can be not entirely detached from the capsule during extraction but solidly maintained in connection with the inner layer 9 at least in certain areas such as at the seal line 15.

The tear-resistant seal portion can also be strategically placed between the two layers to promote a direction of the liquid flow towards the breakable seal portion 11 (not shown). In particular, the tear-resistant seal-portion 15 could delimit restriction openings or channels between the layers which are closed by the breakable seal portion 11. Consequently, the pressurized beverage liquid is guided through these restriction openings or channels towards surfaces of the breakable portion. The restriction openings or channels are very small, e.g., between 0.25 and 2.5 $mm^2$, to allow pressure to build in the capsule.

Figure 2:
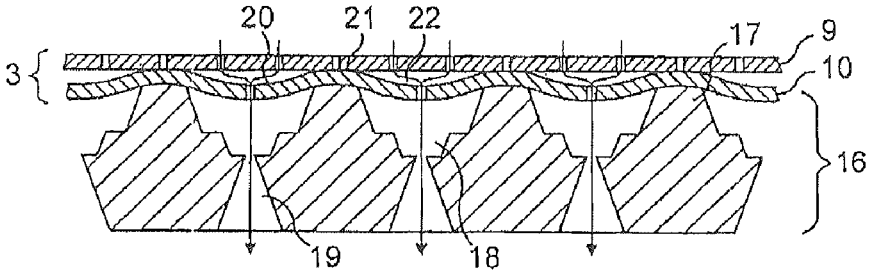
FIG. 2 PRIOR ART
FIG. 2 is a detail view of the delivery wall on a capsule holder such as described in EP0512570 during beverage extraction.

FIG. 2 illustrates the behaviour of the delivery wall when submitted to the extraction pressure of coffee liquid in the capsule. The capsule is typically inserted in a beverage production device such as described in EP0512470B1. The device comprises a capsule holder 16 onto which the capsule is supported and compressed. The capsule holder 16 has a series of relief elements 17 such as two-stage truncated pyramids and recessed elements or channels 18. The channels communicate with each other to form a collecting network for the liquid extract. In the bottom of the recessed elements 18 are provided small orifices 19 for allowing the liquid extract to flow through the capsule holder towards a delivery duct of the device. As water is filled in the chamber of the capsule through the perforations provided by the blades 7, the solid coffee ingredients are wetted by the liquid that progressively fills the chamber until a pressure builds up in the chamber. Coffee extract is formed by interaction between hot pressurized water and coffee particles; which liquid extracts is finally forced to pass through the orifices 12 of first layer 9. As the pressure builds in the capsule, the second layer 10 tends to deform outwardly, i.e., against capsule holder 16. The areas 20 of the lower layer 10 which are positioned above the recessed elements 18 tend to be more deformed than the areas 21 which are supported by the relief elements 17. As the first layer 9 opposes a lesser resistance to pressure, it deforms proportionally less than the second layer 10. This differential deformation of the delivery wall 3 causes the seal portion 11 at the interface of the two layers to delaminate or break. When the seal portion 11 is delaminated or broken, first orifices 12 communicate with the second orifices 13 enabling the liquid extract to be released from the chamber 8. However, since at least a part of the orifices 12, 13 are offset one another, the liquid flow is obliged to take a tortuous path in the confined areas 22 between the two layers 9, 10 until it finds its way out through the second (outer) layer. As a result, the release of the flow is not straight but sufficiently tortuous and confined to maintain a certain pressure inside the chamber. Once the injection of hot water in the capsule ceases, the capsule still empties from liquid as the deformation of the second layer is preferably permanent thereby maintaining the flow path between the orifices 12, 13 sufficiently opened.

As a variant to the embodiment of FIGS. 1 to 3, one can envisage having the seal portion 11 be discontinuous and placed only at local areas between the two layers 9, 10, for example, to selectively block the flow path between first and second orifices. It is also possible to maintain certain regions of the two layers without connection to form channels and/or confined chambers for allowing liquid in and easing delamination of the breakable seal portion.

Figure 4:
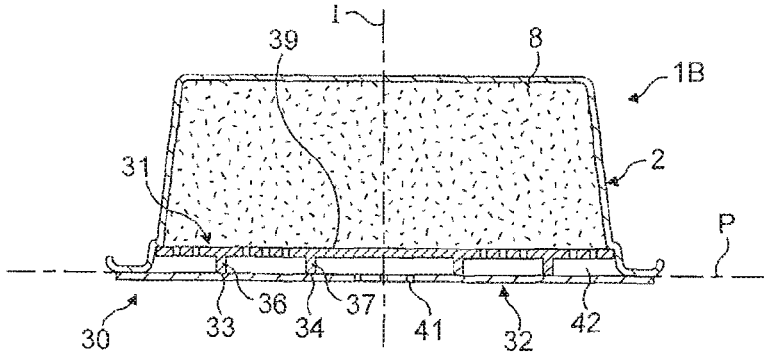
FIG. 4 is a cross section view of a capsule according to a second embodiment of the invention.
Figure 5:
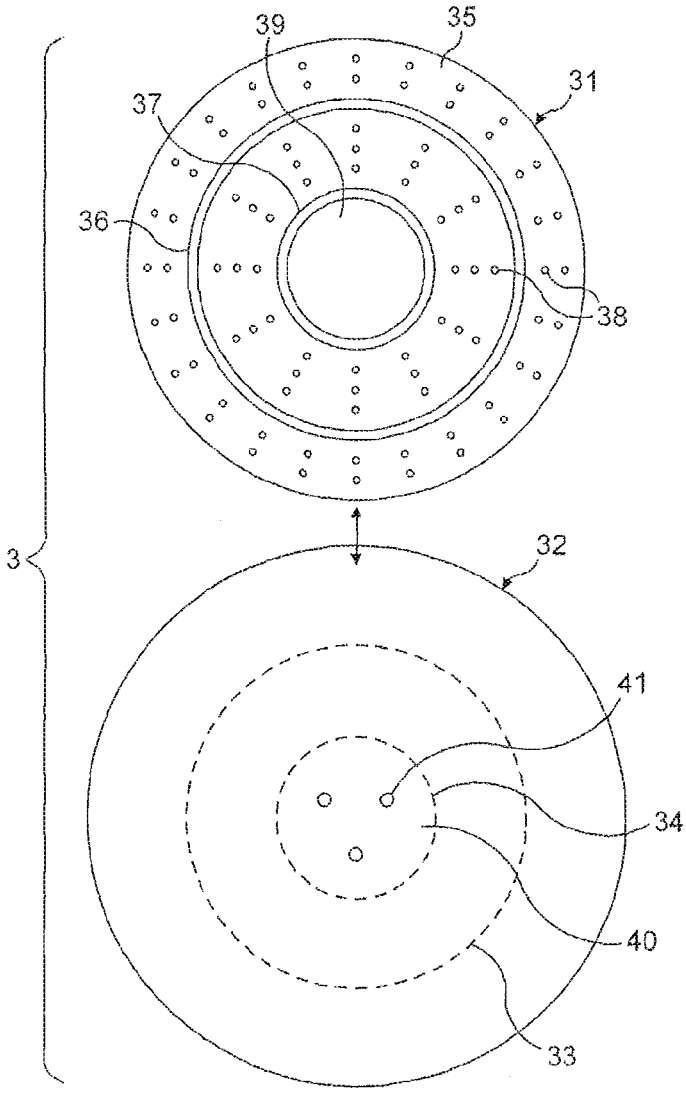
FIG. 5 is an exploded view of the delivery wall of the capsule of FIG. 4.

FIGS. 4 and 5 illustrate another embodiment of the invention in which the capsule 1B comprises a cup-shaped body 2 having a chamber 8 for the ingredients and a delivery wall 30 for closing the chamber. The delivery wall is formed of an inner layer 31 and an outer layer 32 both being connected by a first and second circular breakable seal portions 33, 34. The seal portions 33, 34 are positioned concentrically about the centre of the delivery wall. The inner layer 31 is a rigid plastic element comprising a perforated wall 35 and raised portions 36, 37 protruding in the direction of the outer planar layer 32. The perforated wall 35 comprises a plurality of orifices 38 sufficiently small to retain the coffee particles inside the chamber 8. In the central area 39 of the first layer 31, delimited by the most centrally positioned raised portion 37, the wall is devoid of any orifices.

The second layer 32 is also sealed to the first layer 31 at the contact surfaces of the raised elements 36, 37 by means of a breakable thermofusible film. FIG. 5 shows in dotted lines the sealing line of the first layer 31 onto the second layer 32. It should be noted that the seal portions 33, 34 are directed along a transversal plane P which is directed at an angle of about 90 degrees from the longitudinal axis of each orifice 41 forming the outlet. A gap 42 is maintained between the two layers 31, 32 as a result of the raised portions 36, 37 protruding from the plane of the inner layer. The gap can, for instance, be of between 0.2 and 2 mm.

The second layer 32 has in its central region 40, at least one, preferably several openings 41 of small diameter forming the outlet of the capsule.

The second (inner) openings 41 provided in the outer layer 32 are thus offset transversally with respect to the first (outer) openings 38 provided in the inner layer 31. Furthermore, the flowpath between the openings 38 and the openings 41 is closed by the seal portions 33, 34 in a breakable-under-pressure manner. In particular, the seal portions 33, 34 delimit annular gap portions which are closed before a sufficient pressure is attained upstream of the seal portions.

Figure 6:
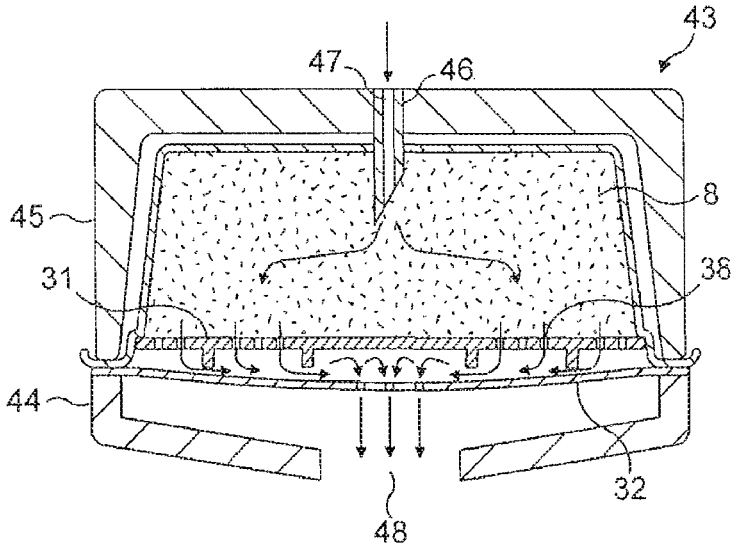
FIG. 6 is a cross section view of a capsule according to the second embodiment during brewing in a beverage production device.
Figure 7:
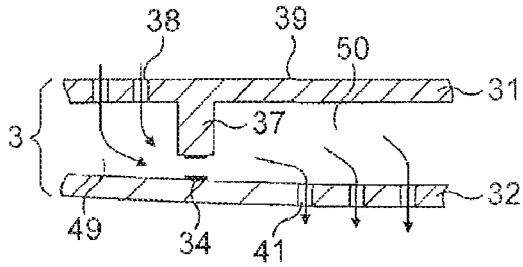
FIG. 7 shows a detail of the delivery wall of FIG. 6.

The use of the capsule 1B can be explained in relation to FIGS. 6 and 7. The capsule is inserted in a beverage production device 43 comprising a capsule holder 44 and a water injection part 45. The injection part has a perforating means 46 with at least one conduit 47 for injecting hot water in the capsule. The capsule holder has a large aperture 48 for enabling the beverage to flow directly from the capsule into the cup or other receptacle. Water can thus be injected in the chamber causing interaction with the coffee ingredients under pressure. The resulting coffee extract leaves the chamber 8 through the small orifices 38 of the inner layer 31. As the liquid extract fills the gap, the seal portions 34, 35 are submitted to the pressure which forces them to break (FIG. 7). The liquid can thus flow from an initially closed portion of gap 49 to a more central portion of gap 50 which is already open to outside by outlet orifices 41. The liquid extract is thus evacuated through the orifices 41 provided in the centre of the second layer 32.

It should be noted that the seal portions 33, 34 can have different tear strength in order to ensure a delayed and successive delamination or breakage. For instance, the less central seal portion 33 can have a lower tear strength than the more central seal portion 34. Therefore, the outermost seal portion 33 breaks before the innermost seal portion 34 enabling the liquid extract to evacuate from all openings 38 of the inner layer towards the openings 41 of the outer layer.

As a variant to the embodiment of FIGS. 4 to 6, one can envisage that a single seal portion 34 is provided and the seal portion 33 is omitted. Also, the raised portion 36 of the inner layer could be omitted or replaced by hindering elements such as a series of studs or small walls. Also, the raised portions could be part of the outer layer and the inner layer could be planar or the raised portions could be part of both the inner and outer layers.

Figure 8:
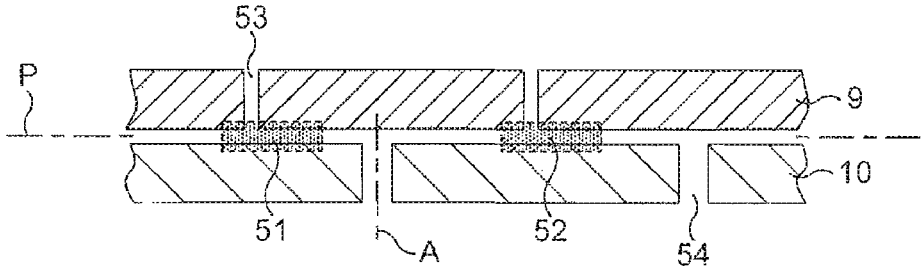
FIG. 8 shows a variant of the delivery wall of FIG. 1A.
Figure 9:
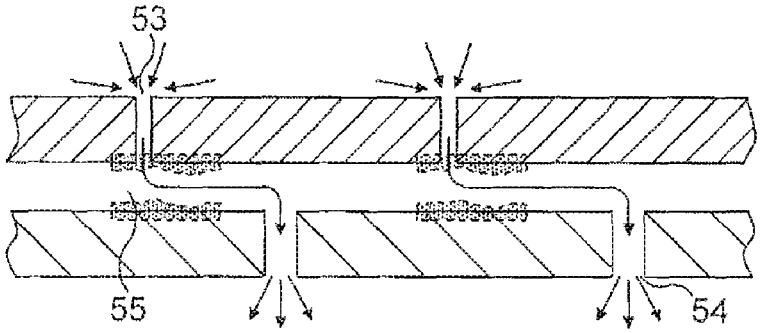
FIG. 9 shows the delivery wall during beverage delivery.

FIGS. 8 and 9 disclose another possible embodiment of the capsule in which the seal portion is realized by discrete seal zones 51, 52 which connect the two layers 9, 10 in a breakable fashion only in localized regions. In this embodiment, the seal zones 51, 52 stop the flow path by sealing the second layer 10 around each orifice 53 of the inner layer. It could be the other way around, as the seal portion could seal the inner layer 9 onto the outer layer around the second orifices 54 of the outer layer 10. Again the orifices 53 and 54 are offset one another. The seal portion extend generally along a plane P which is not aligned with the axis A of the outlet orifices 54 thus forcing the flow to change direction after having entered the confined area 55 between the layers.

Figure 10:
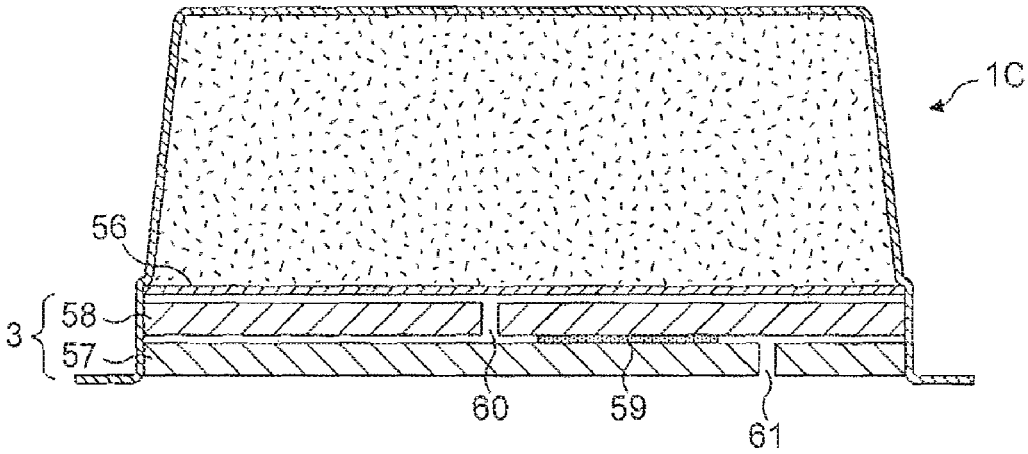
FIG. 10 is a cross section view of a capsule according to a third embodiment of the invention.

In the other embodiment of FIG. 10, the capsule 1C has a delivery wall 3 with two layers 57, 58 sealed by a delaminating or breakable seal portion 59 to which is added at the inside a porous filter 56 such as a porous membrane, paper or meshed material (e.g., non woven). In this case, the filtering function is taken by a separate layer which is not part of the delivery wall per se. The filter 56 prevents the delivery wall from becoming easily clogged by solid particles. The first layer 57 of the delivery wall can be perforated by at least one orifice 60. The second layer has also at least one orifice 61 which is axially offset from orifice 60. Finally, the flow path between the orifices is closed by the breakable seal portion 59. In this embodiment also, the number and dimensions of the orifices in each layer can be varied.

Although the capsule is particularly designed for delivering a coffee beverage from ground coffee, it can contain ingredients chosen amongst the list of: ground coffee, soluble coffee, leaf tea, soluble tea, milk powder, chocolate powder, cocoa powder and combinations thereof. Other beverages or liquid foods that can be formed from particulate beverage or food forming, ingredients can be provided in the capsule when such beverages or liquid foods are to be made from the capsules of the invention.

What is claimed is:

1. A capsule for preparation of a beverage or liquid food in a beverage production machine, the capsule comprising a body and a delivery wall forming a chamber containing beverage ingredient, with the delivery wall comprising at least one outlet, an inner layer and an outer layer forming respectively first and second layers at least partially connected together by at least one seal portion which delaminates or breaks under the pressure of beverage liquid against the seal portion to form the outlet, wherein the first layer comprises at least one orifice and the second layer comprises the outlet in the form of at least a second orifice and wherein the seal portion extends in a direction (P) which differs from the direction (A) of the outlet.

2. The capsule according to claim 1, which contains particulates for formation of a beverage or liquid food.

3. The capsule according to claim 1, wherein the flow path between said first and second orifices is closed by the seal portion before delaminating or breakage and opened thereafter.

4. The capsule according to claim 3, wherein the first and second orifices are substantially offset one another in the transversal direction of the capsule so that the flow path causes the beverage liquid to change direction before exiting the capsule.

5. The capsule according to claim 1, wherein the seal portion is provided along a transversal plane (P) of extension of the delivery wall.

6. The capsule according to claim 1, wherein the first layer comprises a plurality of orifices.

7. The capsule according to claim 6, wherein the first layer comprises a plurality of orifices of a diameter small enough to maintain beverage forming particles in the chamber.

8. The capsule according to claim 1, wherein the second layer comprises fewer orifices than the first layer.

9. The capsule according to claim 1, wherein the two layers are adjacent.

10. The capsule according to claim 1, wherein a gap is present at least in certain regions between the two layers.

11. The capsule according to claim 1, wherein the seal portion extends over the whole contact surfaces of the first and second layers.

12. The capsule according to claim 1, wherein the seal portion extends only partially at the contact surfaces of the first and second layers.

13. The capsule according to claim 1, wherein the first layer and second layers are both flexible foils.

14. The capsule according to claim 1, wherein the first layer is more rigid than the second layer.

15. The capsule according to claim 1, wherein the seal portion delaminates or breaks when a pressure of at least 2 to 3 bars is reached in the capsule.

16. The capsule according to claim 1, wherein the first layer comprises aluminium, PP, PE, PA, PS, PVDC, EVOH, PET, PET, cellulose and combinations thereof and the second layer comprises aluminium, PP, PE, PA, PS, PVDC, EVOH, PET and combinations thereof.

17. A capsule for preparation of a beverage or liquid food in a beverage production machine, the capsule comprising a body and a delivery wall forming a chamber containing a beverage ingredient, with the delivery wall comprising inner and outer layers at least partially connected together by at least one seal portion which delaminates or breaks without external forces but only due to pressure buildup of beverage liquid against the inner layer and seal portion, an outlet comprising one or a plurality of orifices in the outer layer; wherein the inner layer contains one or a plurality of orifices which are substantially offset to the one or more orifices of the outer layer, and wherein the seal portion extends in a direction which differs from the direction of the outlet, such that when the seal portion is delaminated or broken, a flow path is formed for the beverage or liquid food to pass though the orifice(s) of the inner layer and then through the orifice(s) of the outer layer and outlet to exit the capsule, wherein the flow path causes the beverage liquid to change direction between the inner and outer layers before exiting the capsule.

18. The capsule according to claim 17, wherein the first layer comprises a plurality of orifices of a diameter small enough to maintain beverage forming particles in the chamber.

19. The capsule according to claim 17, wherein the first layer and second layers are both flexible foils.

20. The capsule according to claim 17, wherein the seal portion delaminates or breaks when a pressure of at least 2 to 3 bars is reached in the capsule.

* * * * *